US012630912B2

(12) United States Patent
Kang et al.

(10) Patent No.: US 12,630,912 B2
(45) Date of Patent: May 19, 2026

(54) HIGH STRENGTH ZINC-PLATED STEEL SHEET HAVING EXCELLENT UNIFORM SPOT WELDABILITY ALONG WIDTH DIRECTION AND MANUFACTURING METHOD THEREOF

(71) Applicant: POSCO Co., Ltd, Pohang-si (KR)

(72) Inventors: Ki-Cheol Kang, Gwangyang-si (KR); Dae-Young Kang, Gwangyang-si (KR); Tae-Chul Kim, Gwangyang-si (KR); Seul-Gi So, Gwangyang-si (KR); Myung-Soo Kim, Gwangyang-si (KR); Jong-Sang Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 371 days.

(21) Appl. No.: 18/266,784

(22) PCT Filed: Dec. 7, 2021

(86) PCT No.: PCT/KR2021/018408
§ 371 (c)(1),
(2) Date: Jun. 12, 2023

(87) PCT Pub. No.: WO2022/139251
PCT Pub. Date: Jun. 30, 2022

(65) Prior Publication Data

US 2024/0043947 A1 Feb. 8, 2024

(30) Foreign Application Priority Data

Dec. 21, 2020 (KR) ..... 10-2020-0180187

(51) Int. Cl.

| | |
|---|---|
| ***C23C 2/02*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C23C 2/06*** | (2006.01) |
| ***C23C 2/28*** | (2006.01) |
| ***C23C 2/40*** | (2006.01) |

(52) U.S. Cl.
CPC ..... *C23C 2/024* (2022.08); *C21D 8/02* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/22* (2013.01); *C22C 38/26* (2013.01); *C22C 38/28* (2013.01); *C22C 38/32* (2013.01); *C22C 38/34* (2013.01); *C22C 38/38* (2013.01); *C23C 2/02* (2013.01); *C23C 2/0224* (2022.08); *C23C 2/06* (2013.01); *C23C 2/28* (2013.01); *C23C 2/40* (2013.01)

(58) Field of Classification Search
CPC ..... C23C 2/024; C23C 2/02; C23C 2/0224; C23C 2/06; C23C 2/28; C23C 2/40; C23C 2/022; C23C 2/29; C21D 8/0205; C21D 8/0226; C21D 8/0263; C21D 9/46; C21D 2221/02; C21D 1/76; C21D 1/84; C22C 38/001; C22C 38/002; C22C 38/22; C22C 38/26; C22C 38/28; C22C 38/32; C22C 38/34; C22C 38/38; C22C 38/008; C22C 38/02; C22C 38/04; C22C 38/06; C22C 38/12; C22C 38/14; C22C 38/60; B32B 15/013
See application file for complete search history.

(56) References Cited

U.S. PATENT DOCUMENTS

| | | | | |
|---|---|---|---|---|
| 6,398,884 | B1 * | 6/2002 | Kyono | C22C 38/004 148/653 |
| 2018/0010227 | A1 | 1/2018 | Ikeda et al. | |
| 2018/0371570 | A1 | 12/2018 | Kim et al. | |
| 2022/0042155 | A1 | 2/2022 | Kang et al. | |
| 2022/0056564 | A1 | 2/2022 | Kang et al. | |

FOREIGN PATENT DOCUMENTS

| | | | | |
|---|---|---|---|---|
| EP | 3392363 | B1 | | 3/2020 |
| EP | 4079921 | A1 | | 10/2022 |
| JP | 2001-342541 | A | | 12/2001 |
| JP | 2016-128598 | A | | 7/2016 |
| JP | 2019-116655 | A | | 7/2019 |
| KR | 10-2017-0071658 | A | | 6/2017 |
| KR | 1020190073200 | A | * | 6/2019 |
| KR | 10-2020-0076254 | A | | 6/2020 |
| KR | 10-2020-0076772 | A | | 6/2020 |
| KR | 10-2020-0076796 | A | | 6/2020 |
| WO | 2020/130602 | A2 | | 6/2020 |
| WO | 2020/130631 | A1 | | 6/2020 |

OTHER PUBLICATIONS

Extended European Search Report dated Jun. 11, 2024, issued in corresponding European Patent Application No. 21911318.0.
Office Action dated Oct. 29, 2024, issued in corresponding Japanese Patent Application No. 2023-537361.
International Search Report dated Mar. 24, 2022, issued in International Patent Application No. PCT/KR2021/019411 (with English translation).

* cited by examiner

*Primary Examiner* — Ricardo D Morales
(74) *Attorney, Agent, or Firm* — Morgan Lewis & Bockius LLP

(57) ABSTRACT

According to an aspect of the present invention, provided are a high strength zinc-plated steel sheet having excellent uniform spot weldability along the width direction, and a manufacturing method thereof.

10 Claims, No Drawings

HIGH STRENGTH ZINC-PLATED STEEL SHEET HAVING EXCELLENT UNIFORM SPOT WELDABILITY ALONG WIDTH DIRECTION AND MANUFACTURING METHOD THEREOF

CROSS-REFERENCE OF RELATED APPLICATIONS

This application is the U.S. National Phase under 35 U.S.C. § 371 of International Patent Application No. PCT/KR2021/018408, filed on Dec. 7, 2021, which in turn claims the benefit of Korean Application No. 10-2020-0180187, filed on Dec. 21, 2020, the disclosures of which applications are incorporated by reference herein.

TECHNICAL FIELD

The present disclosure relates to a high-strength zinc-plated steel sheet having excellent uniform spot weldability in a width direction and a manufacturing method thereof.

BACKGROUND ART

Due to problems, such as environmental pollution, regulations on automobile exhaust gas and fuel efficiency have been strengthened day by day. As a result, there is an increasing demand for reducing fuel consumption through a weight reduction of automobile steel sheets, and thus, various types of high-strength steel sheets having high strength per unit thickness have been developed and released.

High-strength steel usually means steel having a strength of 490 MPa or more, and transformation induced plasticity (TRIP) steel, twin-induced plasticity (TWIP) steel, dual phase (DP) steel, complex phase (CP) steel, etc. may correspond to the high-strength steel but are not limited thereto.

Meanwhile, automotive steel is supplied in the form of plated steel sheets with a surface plated to ensure corrosion resistance. Thereamong, zinc-plated steel sheet (GI steel sheet), highly corrosion-resistant zinc-plated steel sheet (ZM), or alloyed zinc-plated steel sheet (GA) having high corrosion resistance by using sacrificial anticorrosive properties of zinc have been widely used as a material for automobiles.

However, when the surface of the high-strength steel sheet is plated with zinc, there is a problem in that spot weldability becomes weak. That is, since high-strength steel has high yield strength, as well as high tensile strength, it may be difficult to relieve tensile stress occurring during welding through plastic deformation, so that microcracks are highly likely to occur on the surface. When welding is performed on a high-strength zinc-plated steel sheet, zinc with a low melting point penetrates into microcracks in the steel sheet, and as a result, a phenomenon known as liquid metal embrittlement (LME) may occur, leading to destruction of the steel sheet in a fatigue environment, which may act as a major obstacle to the high strength of the steel sheet.

DISCLOSURE

Technical Problem

An aspect of the present disclosure is to provide a high-strength zinc-plated steel sheet having excellent uniform spot weldability in a width direction and a manufacturing method thereof.

An object of the present disclosure is not limited to the above description. The object of the present disclosure will be understood from the general contents of the present specification, and those skilled in the art to which the present disclosure pertains will have no difficulties in understanding the additional objects of the present disclosure.

Technical Solution

According to an aspect of the present disclosure, a zinc-plated steel sheet as a zinc-plated steel sheet includes a base steel sheet and a zinc-based plated layer provided on a surface of the base steel sheet, wherein an average depth (a) of an internal oxide layer formed in the base steel sheet is 2 μm or more, and a difference (b−c) between an average internal oxide layer depth (b) at an edge portion side of the plated steel sheet in the width direction and an average internal oxide layer depth (c) at a center portion of the plated steel sheet in the width direction may exceed 0.

The average internal oxide layer depth (b) at the edge portion side may be an average value of internal oxide layer depths measured at a point spaced by 0.5 cm from the edge of the plated steel sheet in the width direction to the center portion side of the plated steel sheet in the width direction of the plated steel sheet and at a point spaced apart by 1.0 cm from the edge of the plated steel sheet in the width direction to the center portion side of the plated steel sheet in the width direction of the plated steel sheet, the average internal oxide layer depth (c) at the center portion may be an average value of internal oxide layer depths measured at a point spaced apart by 15 cm from the edge of the plated steel sheet in the width direction to the center portion side of the plated steel sheet in the width direction of the plated steel sheet, at a point spaced apart by 30 cm from the edge of the plated steel sheet in the width direction to the center portion side of the plated steel sheet in the width direction of the plated steel sheet, and at the center of the plated steel sheet in the width direction, and the average depth (a) of the internal oxide layer formed in the base steel sheet may be an average value of the average internal oxide layer depth (b) at the edge portion side and the average internal oxide layer depth (c) at the center portion.

A coating weight of the zinc-based plated layer may be 30 to 70 $g/m^2$.

The base steel sheet may include, by wt %, C: 0.05 to 1.5%, Si: 2.5% or less, Mn: 1.5 to 20.0%, S—Al (acid-soluble aluminum): 3.0% or less, Cr: 2.5% or less, Mo: 1.0% or less, B: 0.005% or less, Nb: 0.2% or less, Ti: 0.2% or less, Sb+Sn+Bi: 0.1% or less, N: 0.01% or less, the balance of Fe, and inevitable impurities.

Tensile strength of the zinc-plated steel sheet may be 900 MPa or more.

A thickness of the base steel sheet may be 1.0 to 2.0 mm.

According to another aspect of the present disclosure, a method of manufacturing a zinc-plated steel sheet may include: reheating a steel slab to a temperature range of 950 to 1300° C.; hot rolling the reheated slab at a finishing rolling start temperature of 900 to 1150° C. and a finishing rolling end temperature of 850 to 1050° C. to provide a hot-rolled steel sheet; coiling the hot-rolled steel sheet in a temperature range of 590 to 750° C.; heating both edges of the coiled hot-rolled coil to a temperature range of 600 to 800° C. at a heating rate of 10° C./s or more for 5 to 24 hours; annealing the hot-rolled steel sheet at a dewpoint temperature of −10 to +30° C., an atmospheric gas of $N_2$-5 to 10% $H_2$, and a soaking zone in a temperature range of 650 to 900° C.; slowly cooling the annealed hot-rolled steel sheet in a slow cooling zone in a temperature range of 550 to 700° C.; quenching the slowly cooled hot-rolled steel sheet in a rapid cooling zone in a temperature range of 270 to 550° C.; reheating the quenched hot-rolled steel sheet and then dipping the reheated steel sheet in a zinc-based plating bath at a dipping temperature of 420 to 550° C. to forma zinc-based plated layer; and selectively alloying the steel sheet on which the zinc-based plated layer is formed by heating in a temperature range of 480 to 560° C.

A threading speed during the annealing may be 40 to 130 mpm.

The steel slab may include, by wt %, C: 0.05-0.30%, Si: 2.5% or less, Mn: 1.5-10.0%, S—Al (acid-soluble aluminum): 1.0% or less, Cr: 2.0% or less, Mo: 0.2% or less, B: 0.005% or less, Nb: 0.1% or less, Ti: 0.1% or less, Sb+Sn+Bi: 0.05% or less, N: 0.01% or less, balance of Fe, and inevitable impurities.

The various features and beneficial advantages and effects of the present disclosure are not limited to the above description, and may be more easily understood in the description of specific exemplary embodiments in the present disclosure.

Advantageous Effects

According to an aspect of the present disclosure, the internal oxide layer having a constant thickness is formed on the surface layer of the base iron directly below the plated layer and the internal oxide layer has a uniform thickness in the width direction of the steel sheet, so that even if tensile stress is applied during spot welding, excellent crack resistance may be provided uniformly in the width direction of the steel sheet, and accordingly, a liquid metal embrittlement (LME) phenomenon caused as the hot-dip galvanized layer penetrates along the cracks may be equally suppressed in the width direction of the steel sheet.

Effects of the present disclosure are not limited to the above, and may be interpreted as including technical effects that may be inferred from the details described below by those skilled in the art.

BEST MODE FOR INVENTION

The present disclosure relates to a high-strength zinc-plated steel sheet having excellent uniform spot weldability in a width direction and a manufacturing method thereof. Hereinafter, exemplary embodiments of the present disclosure will be described. Exemplary embodiments of the present disclosure may be modified in various forms, and the scope of the present disclosure should not be construed as being limited to the exemplary embodiments described below. These exemplary embodiments are provided to those skilled in the art to further elaborate the present disclosure.

Hereinafter, a zinc-plated steel sheet of the present disclosure will be described through several exemplary embodiments.

It should be noted that the term of zinc-plated steel sheet in the present disclosure includes not only zinc-plated steel sheet (GI steel sheet) but also alloyed zinc-plated steel sheet (GA), as well as all plated steel sheets formed with a zinc-based plated layer mainly including zinc. The fact that zinc is mainly included means that a proportion of zinc among the elements included in the plated layer is the highest. As an example, a zinc-plated steel sheet (ZM) having high corrosion resistance may be included therein. However, in an alloyed zinc-plated steel sheet, the ratio of iron may be higher than that of zinc, and a steel sheet having the highest ratio of zinc among components other than iron may be included in the scope of the present disclosure.

The inventors of the present disclosure focused on the fact that liquid metal embrittlement (LME) occurring during welding has its origin in microcracks occurring from a surface of the steel sheet, and studied a unit of suppressing microcracks on the surface. To this end, the inventors of the present disclosure discovered that it was necessary to specifically control a microstructure on the surface of the steel sheet, which led to the present disclosure.

In general, high-strength steel may include a large amount of elements, such as carbon (C), manganese (Mn), and silicon (Si) in order to secure hardenability or austenite stability of the steel. These elements serve to increase susceptibility to cracks of the steel. Therefore, microcracks may easily occur in the steel including a large amount of these elements, ultimately causing LME during welding. According to research results of the present inventors, the occurrence behavior of such microcracks is closely related to a carbon concentration. As the carbon concentration in a surface layer of the steel sheet is lower, a soft ferrite layer is formed on the surface layer portion so that cracks do not occur due to tensile stress occurring during spot welding, and stress may be relieved by plastic deformation, so that cracks do not occur and cracks of a spot welded portion may be reduced. Since a soft ferrite formation fraction is affected by a depth of internal oxidation of the surface layer portion, the level of LME crack improvement in the spot welded portion may be proportional to a thickness of the internal oxide layer formed in the surface layer portion.

In addition, if a non-uniform internal oxide layer is formed locally even in a partial region with respect to the steel sheet entirely in the width direction, uniform LME crack resistance cannot be provided. Therefore, it is important that the internal oxide layer formed to a depth of a certain level or more should be uniformly formed in the steel sheet entirely in the width direction.

According to an exemplary embodiment in the present disclosure, in a zinc-plated steel sheet including a base steel sheet and a zinc-based plated layer provided on the surface of the base steel sheet, an average depth (a) of an internal oxide layer formed in the base steel sheet is 2 μm or more, and a difference (b−c) between an average internal oxide layer depth (b) at an edge portion side of the plated steel sheet in the width direction and an average internal oxide layer depth (c) at a center portion of the plated steel sheet in the width direction may exceed 0. A preferred depth difference (b−c) of the internal oxide layer may be greater than 0 and less than or equal to 1.5.

The average internal oxide layer depth (b) at the edge portion side may be an average value of internal oxide layer depths measured at a point spaced apart by 0.5 cm from the edge of the plated steel sheet in the width direction to the center portion side of the plated steel sheet in the width direction of the plated steel sheet and at a point spaced apart by 1.0 cm from the edge of the plated steel sheet in the width direction to the center portion side of the plated steel sheet in the width direction of the plated steel sheet, the average internal oxide layer depth (c) at the center portion may be an average value of internal oxide layer depths measured at a point spaced apart by 15 cm from the edge of the plated steel sheet in the width direction to the center portion side of the plated steel sheet in the width direction of the plated steel sheet, at a point spaced apart by 30 cm from the edge of the plated steel sheet in the width direction to the center portion side of the plated steel sheet in the width direction of the plated steel sheet, and at the center of the plated steel sheet in the width direction, and the average depth (a) of the internal oxide layer formed in the base steel sheet may be an average value of the average internal oxide layer depth (b) at the edge portion side and the average internal oxide layer depth (c) at the center portion. A person skilled in the art may measure the average depth (a) of the internal oxide layer formed in the base steel sheet, the average internal oxide layer depth (b) of the edge portion, and the average internal oxide layer depth (c) of the center portion by utilizing a known measurement method without any special technical difficulties.

According to an exemplary embodiment in the present disclosure, since the average depth (a) of the internal oxide layer formed on the base steel sheet is controlled to a level of 2 μm or more, a soft surface layer portion may be formed with a sufficient thickness. Therefore, plastic deformation may occur in the soft surface layer portion during spot welding to consume tensile stress occurring during spot welding, thereby effectively suppressing crack susceptibility of the steel sheet.

Meanwhile, in the case of manufacturing a cold-rolled plated steel sheet under normal process conditions, an internal oxide layer formed in the center portion in the width direction is inevitably formed to a deeper depth than the internal oxide layer formed at the edge portion in the width direction. When manufacturing the cold-rolled steel sheet, a process of coiling the hot-rolled steel sheet into a hot-rolled coil in a certain temperature range is necessarily involved. Since the center portion of the hot-rolled coil coiled in a certain temperature range or higher is maintained at a relatively high temperature for a long period of time compared to the edge portion of the hot-rolled coil, internal oxidation occurs more actively in the center portion of the hot-rolled coil than in the edge portion of the hot-rolled coil. This internal oxidation tendency is maintained in the final cold-rolled zinc-plated steel sheet and eventually causes variation in LME resistance in the width direction of the final steel sheet.

Meanwhile, the zinc-plated steel sheet according to an exemplary embodiment in the present disclosure not only has the internal oxidation layer having an average depth of 2 μm or more on the surface layer portion of the base steel sheet but also control the internal oxidation layer formed at the center portion side of the plated steel sheet to have a greater thickness, compared to the internal oxide layer formed at the edge portion side of the plated steel sheet, so that excellent LME resistance may be equally implemented in the width direction of the steel sheet.

The present disclosure does not limit the type as long as it is a high-strength steel sheet having a strength of 900 MPa or more. However, the steel sheet to be targeted in the present disclosure may include, but is not limited to, by wt %, C: 0.05 to 1.5%, Si: 2.5% or less, Mn: 1.5 to 20.0%, S—Al (acid-soluble aluminum): 3.0% or less, Cr: 2.5% or less, Mo: 1.0% or less, B: 0.005% or less, Nb: 0.2% or less, Ti: 0.2% or less, Sb+Sn+Bi: 0.1% or less, N: 0.01% or less, the balance of Fe, and inevitable impurities. In some cases, elements that may be included in the steel not listed above may be further included up to a total of 1.0 wt % or less. In the present disclosure, the content of each component element is expressed based on weight unless otherwise specified. The aforementioned composition refer to a bulk composition of the steel sheet, that is, a composition at a ¼ point of the thickness of the steel sheet (hereinafter, the same).

In some exemplary embodiments of the present disclosure, the high-strength base steel sheet may be TRIP steel, DP steel, CP steel, and the like. These steels may have the following composition when classified in detail.

Steel composition 1: It includes C: 0.05 to 0.30% (preferably 0.10 to 0.25%), Si: 0.5 to 2.5% (preferably 1.0 to 1.8%), Mn: 1.5 to 4.0% (preferably 2.0 to 3.0%)), S—Al: 1.0% or less (preferably 0.05% or less), Cr: 2.0% or less (preferably 1.0% or less), Mo: 0.2% or less (preferably 0.1% or less), B: 0.005% or less (preferably 0.004% or less), Nb: 0.1% or less (preferably 0.05% or less), Ti: 0.1% or less (preferably 0.001 to 0.05%), Sb+Sn+Bi: 0.05% or less, N: 0.01% or less, the balance of Fe, and inevitable impurities. In some cases, elements that are not listed above but may be included in the steel may be further included up to a total of 1.0% or less.

Steel composition 2: It includes C: 0.05 to 0.30% (preferably 0.10 to 0.2%), Si: 0.5% or less (preferably 0.3% or less), Mn: 4.0 to 10.0% (preferably 5.0 to 9.0%), S—Al: 0.05% or less (preferably 0.001 to 0.04%), Cr: 2.0% or less (preferably 1.0% or less), Mo: 0.5% or less (preferably 0.1 to 0.35%), B: 0.005% or less (preferably 0.004% or less), Nb: 0.1% or less (preferably 0.05% or less), Ti: 0.15% or less (preferably 0.001 to 0.1%), Sb+Sn+Bi: 0.05% or less, N: 0.01% or less, the balance of Fe, and inevitable impurities. In some cases, elements that are not listed above but may be included in the steel may be further included up to a total of 1.0% or less.

In addition, when a lower limit of the content of each of the above-described component elements is not limited, these component elements may be regarded as arbitrary elements, and the content thereof may be 0%.

Although not necessarily limited thereto, the thickness of the base steel sheet according to an exemplary embodiment in the present disclosure may be 1.0 to 2.0 mm.

According to an exemplary embodiment in the present disclosure, one or more plated layers may be included in the surface of the steel sheet, and the plated layer may be a zinc-based plated layer including a galvanized (GI), galvannealed (GA), or zinc-magnesium-aluminum (ZM) layer. In the present disclosure, since a ferrite fraction and an average grain size of the surface layer portion are controlled within an appropriate range as described above, liquid metal embrittlement occurring during spot welding may be effectively prevented even if the zinc-based plated layer is formed on the surface of the steel sheet.

According to an exemplary embodiment in the present disclosure, when the zinc-based plated layer is a GA layer, the degree of alloying (referring to the Fe content in the plated layer) may be controlled to be 8 to 13 wt %, preferably, 10 to 12 wt %. If the degree of alloying is not sufficient, zinc in the zinc-based plated layer may penetrate into microcracks to cause liquid metal embrittlement, and conversely, if the degree of alloying is too high, problems, such as powdering, may occur.

In addition, a coating weight of the zinc-based plated layer may be 30 to 70 g/m$^2$. If the plating amount is too small, it is difficult to obtain sufficient corrosion resistance. Meanwhile, if the plating amount is too high, manufacturing costs may increase and liquid metal embrittlement problems may occur, and thus, the coating weight is controlled to the aforementioned range. Amore preferable range of coating weight may be 40 to 60 g/m$^2$. This coating weight refers to the amount of the plated layer attached to a final product. When the plated layer is GA, the coating weight increases due to alloying, and thus, the weight may be slightly reduced before alloying, and since the coating weight varies depending on the degree of alloying, the coating weight (that is, the amount of plating deposited from the plating bath) before alloying may be a value reduced by about 10%, but is not limited thereto.

Hereinafter, an exemplary embodiment for manufacturing a steel sheet of the present disclosure will be described. However, it should be noted that the steel sheet of the present disclosure does not necessarily have to be manufactured by the following exemplary embodiments, and the following exemplary embodiment is one preferred method for manufacturing the steel sheet of the present disclosure.

First, a hot-rolled steel sheet may be manufactured by reheating a steel slab having the above-described composition, hot-rolling the slab through rough rolling and finishing rolling, and then undergoing the slab ROT (Run Out Table) cooling and coiling. Thereafter, pickling may be performed on the manufactured steel sheet and cold rolling may be performed thereon, and the obtained cold rolled steel sheet may be annealed and plated. Hot rolling conditions, such as ROT cooling, are not particularly limited, but in an exemplary embodiment in the present disclosure, slab heating temperature, finishing rolling start and end temperature, a coiling temperature, pickling conditions, cold rolling conditions, annealing conditions, and plating conditions may be limited as follows.

Slab Heating Temperature: 950 to 1300° C.

Slab heating is performed to secure rollability by heating a material before hot rolling. During reheating of the slab, a surface layer of the slab combines with oxygen in a furnace to form a scale which is an oxide. When the scale is formed, it also reacts with carbon in the steel to cause a decarburization reaction to form carbon monoxide gas, and as the slab reheating temperature increases, the amount of decarburization increases. If the slab reheating temperature is excessively high, a decarburization layer is excessively formed and a material of a final product may be softened, and if the slab reheating temperature is excessively low, hot rolling properties may not be secured to cause edge cracks, and hardness of the surface layer portion may not be sufficiently lowered so that the LME improvement may be insufficient.

Finishing Rolling Start Temperature: 900 to 1150° C.

If the finishing rolling start temperature is excessively high, surface hot-rolled scale may be excessively developed to increase the amount of surface defects caused by the scale of the final product, so an upper limit thereof is limited to 1150° C. In addition, if the finishing rolling start temperature is less than 900° C., rigidity of a bar may increase due to a reduction in temperature to significantly reduce the hot rolling properties, and thus, the finishing rolling start temperature may be limited to the above range.

Finishing Rolling End Temperature: 850 to 1050° C.

If the finishing rolling end temperature exceeds 1,050° C., the scale removed by descaling during finishing rolling may be excessively formed on the surface again, increasing the amount of surface defects, and if the finishing rolling end temperature is less than 850° C., the hot rolling properties may be lowered, and thus, the finish rolling end temperature may be limited to the above range.

Coiling Temperature: 590 to 750° C.

The hot-rolled steel sheet is then coiled into a coil and stored, and the coiled steel sheet undergoes a slow cooling process. By this process, the hardenable elements included in the surface layer portion of the steel sheet are removed. If the coiling temperature of the hot-rolled steel sheet is too low, it may be difficult to achieve a sufficient effect because the coil is slowly cooled at a temperature lower than the temperature required for oxidative removal of these elements.

Hot-Rolled Coil Edge Portion Heating: Heating for 5 to 24 Hours by Raising the Temperature to a Temperature Range of 600 to 800° C. at a Heating Rate of 10° C./s or More In an exemplary embodiment in the present disclosure, the edge portion of the hot-rolled coil may be heated in order to reduce a difference in LME resistance and depth deviation of the internal oxide layer between the edge portion and an inner region of the edge portion in the width direction. Heating the edge portion of the hot-rolled coil means heating both ends of the coiled coil in the width direction, that is, the edge portion, and by heating the edge portion, the edge portion is first heated to a temperature suitable for oxidation. That is, the inside of the coiled coil is maintained at a high temperature, but the edge portion is cooled relatively quickly, and as a result, a time maintained at the temperature suitable for internal oxidation is shorter at the edge portion. Therefore, the removal of oxidizing elements at the edge portion is not as active compared to the center portion in the width direction. Edge heating may be used as a method for removing oxidizing elements from the edge portion.

That is, when edge portion heating is performed, the edge portion is first heated, contrary to the case of cooling after coiling, and thus the temperature of the edge portion in the width direction is maintained to be suitable for internal oxidation. As a result, a thickness of the internal oxidation layer of the edge portion increases. To this end, the edge portion heating temperature needs to be 600° C. or higher (based on the temperature of the edge portion of the steel sheet). However, if the temperature is too high, the scale may be excessively formed on the edge portion during heating or porous highly oxidized scale (hematite) may be formed, resulting in a poor surface condition after pickling, and therefore, the temperature of the edge portion may be 800° C. or less. A more preferable edge portion heating temperature is 600 to 750° C.

In addition, in order to eliminate non-uniformity in the depth of the internal oxide layer of the steel sheet between the edge portion and the center portion in the width direction occurring during coiling, a heating time for the edge portion needs to be 5 hours or more. However, if the heating time of the edge portion is too long, the scale may be excessively formed or grain boundary brittleness of the internal oxide layer of the edge portion may increase. Therefore, the edge portion heating time may be 24 hours or less.

In addition, when heating the edge portion of the hot-rolled coil, a heating rate is preferably 10° C./s or more. If the heating rate is less than 10° C./s, $Fe_2SiO_4$, which is a Si-based oxide in a low-temperature region, may be excessively generated to suppress formation of internal oxide in the final steel sheet. $Fe_2SiO_4$ excessively formed in a low-temperature region may remain in the steel sheet in the form of $SiO_2$ even after pickling, so even if a dew point temperature is increased during annealing, the penetration and diffusion of oxygen into the surface layer portion of the steel sheet may be suppressed to suppress internal oxidation, thereby degrading LME resistance. In addition, Si-based oxide remaining on the surface of the steel sheet may grow during annealing and deteriorate plating wettability and plating physical properties with respect to molten zinc.

According to an exemplary embodiment in the present disclosure, the edge portion heating may be performed by a combustion heating method through an air-fuel ratio control. That is, an oxygen fraction in the atmosphere may be changed by adjusting the air-fuel ratio, and as an oxygen partial pressure increases, an oxygen concentration in contact with the surface layer of the steel sheet may increase, so that decarburization or internal oxidation may increase. Although not necessarily limited thereto, in an exemplary embodiment in the present disclosure, a nitrogen atmosphere containing 1 to 2% of oxygen may be controlled by adjusting the air-fuel ratio. Since those skilled in the art may control the oxygen fraction by adjusting the air-fuel ratio without any special difficulty, this will not be separately described.

Pickling: Performed at Threading Speed of 180 to 250 mpm

The hot-rolled steel sheet that has undergone the above-described process is put into a hydrochloric acid bath to perform pickling treatment in order to remove the hot-rolled scale. During pickling, a hydrochloric acid concentration in the hydrochloric acid bath is in the range of 10 to 30%, and a pickling threading speed is 180 to 250 mpm. If the pickling speed exceeds 250 mpm, the scale on the surface of the hot-rolled steel sheet may not be completely removed, and if the pickling speed is lower than 180 mpm, the surface layer portion of the base steel may be corroded by hydrochloric acid, and thus, the pickling threading speed is 180 mpm or more.

Cold Rolling: Reduction Rate of 35 to 60%

After pickling, cold rolling is performed. During cold rolling, a cold rolling reduction ratio is in the range of 35 to 60%. If the cold rolling reduction ratio is less than 35%, there is no particular problem but it may be difficult to sufficiently control the microstructure due to insufficient recrystallization driving force during annealing. If the cold rolling reduction ratio exceeds 60%, a thickness of a soft layer secured during hot rolling may become thin, making it difficult to lower the hardness within a sufficient region within 20 μm of the surface of the steel sheet after annealing.

After the above-described cold rolling process, a process of annealing the steel sheet may be followed. Since an average ferrite grain size and fraction of the surface portion of the steel sheet may vary significantly even during the annealing process of the steel sheet, in an exemplary embodiment in the present disclosure, the annealing process may be controlled under the conditions of appropriately controlling the average ferrite grain size and fraction of a region within 50 μm from the surface of the steel sheet.

Threading Speed: 40 to 130 Mpm

In order to secure sufficient productivity, a threading speed of the cold-rolled steel sheet needs to be 40 mpm or more. However, excessively fast threading speed may be disadvantageous in terms of securing the material, so in an exemplary embodiment in the present disclosure, an upper limit of the threading speed may be set to 130 mpm.

Heating Zone Heating Rate: 1.3 to 4.3° C./s

In order to ensure the ferrite fraction and average grain size of the surface layer portion within a suitable range, it is advantageous to control the heating rate in the heating zone. If the heating rate in the heating zone is low, the amount of Si oxidation may increase in the region of 650° C. or higher to form an oxide film in the form of a continuous film on the surface, and water vapor may contact the surface of the steel sheet to remarkably reduce the amount of dissociating into oxygen, and since the oxide film inhibits a reaction between carbon and oxygen on the surface, decarburization may not be sufficiently achieved, and thus, LME resistance may become inferior. In addition, an oxide film may be formed on the surface, resulting in poor plating wettability, and therefore, plating surface quality may be inferior. Accordingly, in an exemplary embodiment in the present disclosure, a lower limit of the heating rate of the heating zone may be set to 1.3° C./s.

Meanwhile, if the heating rate in the heating zone is high, austenite phase transformation may not be smooth in recrystallization and two-phase temperature range or more during the heating process. In TRIP steel, in the process of simultaneously forming ferrite and austenite in the two-phase temperature range, carbon formed of cementite is dissociated, and partitioning proceeds to austenite with high carbon solid solubility, resulting in an increase in amount of solid solution of carbon, and thus, a hard low-temperature phase, such as martensite, may become stable. Meanwhile, if the heating rate is high, the austenite fraction may be lowered and the low-temperature phase is not sufficiently formed due to a decrease in carbon partitioning, which may cause a decrease in strength. Accordingly, in an exemplary embodiment in the present disclosure, an upper limit of the heating rate of the heating zone may be set to 4.3° C./s.

Control of Dew Point in the Annealing Furnace: Controlled within Range of −10 to +30° C. at 650 to 900° C.

It is advantageous to control a dew point in an annealing furnace in order to obtain a surface layer ferrite fraction and average grain size in an appropriate range. If the dew point is too low, there is a possibility that oxides, such as Si or Mn, may be formed on the surface due to surface oxidation rather than internal oxidation. These oxides adversely affect plating. Therefore, the dew point needs to be controlled to −10° C. or higher. Conversely, if the dew point is too high, oxidation of Fe may occur, so the dew point needs to be controlled to 30° C. or less. As such, the temperature for controlling the dew point may be 650° C. or higher, which is a temperature at which a sufficient internal oxidation effect appears. However, if the temperature is too high, surface oxides, such as Si, may be formed to hinder the diffusion of oxygen to the inside, excessive austenite may be generated during soaking zone heating, which lowers a carbon diffusion rate, thereby lowering an internal oxidation level, and the soaking zone austenite may grow excessively in size, resulting in material softening. In addition, since problems of shortening the life of a facility and increasing process cost by generating a load in the annealing furnace, the temperature for controlling the dew point may be 900° C. or less.

At this time, the dew point may be adjusted by introducing moist nitrogen ($N_2$+$H_2O$) including water vapor into the annealing furnace.

Hydrogen Concentration in Annealing Furnace: 5 to 10 Vol %

The atmosphere in the annealing furnace maintains a reducing atmosphere by adding 5 to 10 Vol % hydrogen to nitrogen gas. If the hydrogen concentration in the annealing furnace is less than 5 vol %, surface oxides may be excessively formed due to a decrease in reducing ability, resulting in poor surface quality and plating adhesion, and the surface oxides may suppress a reaction between oxygen and carbon in the steel, resulting in a decrease in decarburization and LME improvement level. If the hydrogen concentration is high, no special problem may occur, but the hydrogen concentration is limited due to the increase in cost according to an increase in a usage amount of hydrogen gas and the risk of explosion in the furnace due to an increase in hydrogen concentration.

The steel sheet annealed by the above process may be cooled through slow cooling and rapid cooling steps.

Cooling Zone Temperature During Slow Cooling: 550 to 700° C.

The slow cooling zone refers to a section in which a cooling rate is 3 to 5° C./s. If the slow cooling zone temperature exceeds 700° C., soft ferrite may be excessively formed during slow cooling, reducing tensile strength. If the slow cooling zone temperature is less than 550° C., bainite may be excessively formed or martensite may be formed, so that tensile strength may excessively increase and elongation may decrease. Therefore, the slow cooling zone temperature may be limited to the above range.

Cooling Zone Temperature During Rapid Cooling: 270 to 550° C.

The rapid cooling zone refers to a section in which a cooling rate is 12 to 20° C./s. If the rapid cooling zone temperature exceeds 550° C., tensile strength may be insufficient due to the formation of martensite below a proper level during rapid cooling. If the rapid cooling zone temperature is less than 270° C., the formation of martensite may be excessive and elongation may be insufficient.

The steel sheet annealed by this process is directly immersed in a plating bath and subjected to hot-dip galvanizing. When the steel sheet is cooled, heating the steel sheet may be further included. The heating temperature needs to be higher than a dipping temperature of the steel sheet, which will be described below, and may be higher than a temperature of the plating bath in some cases.

Dipping Temperature of Steel Sheet to Plating Bath: 420 to 500° C.

If the dipping temperature of the steel sheet in the plating bath is low, wettability in a contact interface between the steel sheet and liquid zinc may not be sufficiently secured, so the dipping temperature should be maintained at 420° C. or higher. If the dipping temperature is excessively high, the reaction between the steel sheet and liquid zinc may be excessive and a Fe—Zn alloy phase, zetta phase, may occur at the interface, reducing adhesion of the plated layer, and the elution amount of the Fe element of the steel sheet in the plating bath may become excessive, resulting in dross in the plating bath. Therefore, the dipping temperature of the steel sheet may be limited to 500° C. or less.

Al Concentration in Plating Bath: 0.10 to 13.0%

The Al concentration in the plating bath should be maintained at an appropriate concentration to secure the wettability of the plated layer and fluidity of the plating bath. GA needs to be controlled to 0.10 to 0.15%, GI needs to be controlled to 0.2 to 0.25%, and ZM needs to be controlled to 0.7 to 13.0% to maintain the dross formation in the plating bath at an appropriate level and secure plating surface quality and performance.

The zinc-plated steel sheet plated by the above-described process may then undergo an alloying heat treatment process, if necessary. Preferred conditions for alloying heat treatment are as follows.

Alloying (GA) Temperature: 480 to 560° C.

If the temperature is less than 480° C., the degree of alloying is insufficient due to a small amount of Fe diffusion, which may lead to poor plating properties. If the temperature exceeds 560° C., powdering problems may occur due to excessive alloying, and the material may deteriorate due to ferrite transformation of retained austenite, and therefore, the alloying temperature is set within the above range.

MODE FOR INVENTION

Hereinafter, the present disclosure will be described in more detail through examples. However, it should be noted that the exemplary embodiments to be described below are only for exemplifying and embodying the present disclosure and are not intended to limit the scope of the present disclosure.

Example

A steel slab (the remaining components not listed in the table are Fe and inevitably included impurities. In the table, B is expressed in ppm units, and the remaining components are expressed by wt % units) having a composition shown in Table 1 below was heated to 1230° C., and hot rolling was performed by setting a finishing rolling start temperature and a finishing rolling end temperature to 1015° C. and 950° C., respectively. Thereafter, coiling and hot-rolled coil edge portion heating were performed under the conditions shown in Table 2. After heating the edge portion, pickling was performed with a 19.2% by volume of hydrochloric acid solution, and cold rolling was performed, and the obtained cold-rolled steel sheet was annealed in an annealing furnace, slow-cooled at 4.2° C./s in a slow cooling zone at 620° C., and rapidly cooled in a rapid cooling zone at 315° C. and at 17° C./s to obtain an annealed steel sheet. Thereafter, the obtained steel sheet was heated, and GA was immersed in a plating bath with 0.13% of Al, GI was immersed in a zinc-based plating bath with 0.24 wt % of Al, and ZM was immersed in a zinc-based plating bath with 1.75% of Al and 1.55% of Mg to perform hot-dip galvanizing. The obtained zinc-plated steel sheet was subjected to alloying (GA) heat treatment at 520° C., if necessary, to finally obtain an alloyed zinc-plated steel sheet.

In all examples, a dipping temperature of the steel sheet dipped into the hot-dip galvanizing bath was set to 475° C. Other conditions for each of the examples are as described in Table 2, and process conditions not specifically mentioned above were carried out to satisfy the process conditions of the present disclosure described above.

TABLE 1

| Steel | Alloy composition (wt %) | | | | | | | | | | | |
|---|---|---|---|---|---|---|---|---|---|---|---|---|
| type | C | Si | Mn | S—Al | Cr | Mo | B | Nb | Ti | Sb | Sn | Bi |
| A | 0.152 | 3.752 | 2.321 | 0.0023 | 0.23 | 0.021 | 12 | 0.032 | 0.017 | 0.032 | 0 | 0.001 |
| B | 0.215 | 1.542 | 2.321 | 0.0017 | 0 | 0 | 9 | 0.031 | 0.014 | 0 | 0 | 0 |
| C | 0.105 | 1.009 | 22.45 | 0.0024 | 0 | 0 | 1 | 0.012 | 0.013 | 0 | 0 | 0 |
| D | 0.142 | 1.485 | 2.04 | 0.0014 | 0.32 | 0 | 8 | 0 | 0.011 | 0.021 | 0 | 0 |
| E | 0.145 | 1.121 | 2.15 | 0.0012 | 0.12 | 0.012 | 4 | 0.017 | 0.019 | 0.021 | 0 | 0 |
| F | 0.112 | 1.497 | 2.54 | 0.0012 | 0 | 0 | 11 | 0.012 | 0.021 | 0 | 0.014 | 0 |
| G | 0.253 | 3.015 | 2.12 | 0.0014 | 0 | 0 | 12 | 0.041 | 0.014 | 0 | 0 | 0 |

TABLE 2

| | | Hot-rolled | Heating of hot-rolled coil edge portion | | | | Annealing furnace | Soaking | 650-900° C. | Hydrogen concentration |
|---|---|---|---|---|---|---|---|---|---|---|
| Steel type | Specimen No. | colling temperature (° C.) | Heating temperature (° C.) | Heating rate (° C./s) | Heating time (hr) | Pickling rate (mpm) | threading speed (mpm) | zone temperature (° C.) | Dew point (° C.) | in annealing furnace (Vol %) |
| F | 1 | 701 | 832 | 12 | 21 | 194 | 80 | 867 | 12 | 8 |
| A | 2 | 621 | 624 | 13 | 20 | 184 | 121 | 800 | 12 | 6 |
| F | 3 | 645 | 702 | 13 | 11 | 195 | 71 | 754 | 25 | 5 |
| B | 4 | 490 | 654 | 11 | 14 | 201 | 90 | 810 | 14 | 6 |
| D | 5 | 654 | 621 | 15 | 12 | 201 | 162 | 814 | 12 | 6 |
| F | 6 | 614 | 658 | 21 | 15 | 204 | 75 | 785 | 15 | 5 |
| E | 7 | 648 | 617 | 17 | 12 | 214 | 75 | 621 | 20 | 5 |
| D | 8 | 607 | 621 | 14 | 12 | 224 | 80 | 842 | 45 | 6 |
| B | 9 | 608 | 607 | 12 | 14 | 190 | 90 | 835 | 15 | 1.2 |
| B | 10 | 621 | 701 | 11 | 14 | 195 | 100 | 780 | 5 | 5 |
| E | 11 | 621 | 720 | 12 | 16 | 201 | 42 | 790 | 10 | 5 |
| A | 12 | 604 | 647 | 13 | 10 | 201 | 95 | 804 | 15 | 5 |
| F | 13 | 702 | 608 | 14 | 15 | 285 | 71 | 814 | 11 | 5 |
| D | 14 | 862 | 625 | 15 | 12 | 201 | 85 | 850 | 5 | 7 |
| D | 15 | 652 | 621 | 21 | 12 | 201 | 72 | 722 | 14 | 5 |
| F | 16 | 621 | 608 | 20 | 14 | 208 | 80 | 842 | −32 | 5 |
| B | 17 | 645 | 711 | 11 | 28 | 218 | 74 | 812 | 1 | 9 |
| E | 18 | 621 | 752 | 13 | 14 | 214 | 80 | 775 | 3 | 5 |
| C | 19 | 614 | 621 | 12 | 21 | 193 | 100 | 802 | 14 | 5 |
| B | 20 | 623 | 631 | 13 | 11 | 210 | 35 | 832 | 15 | 6 |
| D | 21 | 634 | 674 | 14 | 10 | 231 | 50 | 925 | 5 | 6 |
| E | 23 | 654 | 565 | 12 | 12 | 221 | 75 | 842 | 5 | 8 |
| E | 24 | 632 | 671 | 11 | 10 | 201 | 65 | 785 | 20 | 5 |
| E | 25 | 695 | 631 | 13 | 4 | 204 | 70 | 821 | 7 | 8 |
| B | 27 | 701 | 687 | 11 | 10 | 78 | 52 | 807 | 14 | 6 |
| B | 28 | 631 | 696 | 10 | 17 | 201 | 74 | 754 | −7 | 5 |
| F | 29 | 634 | 702 | 2 | 12 | 222 | 68 | 831 | 13 | 7 |

The properties of the hot-dip galvanized steel sheets manufactured by the above-described process were measured. The results of observing whether or not liquid metal embrittlement (LME) occurs during spot welding are shown in Table 3. The spot welding was performed along each cut edge obtained by cutting the steel sheet in a width direction. A spot welding current was applied twice and a hold time of 1 cycle was maintained after applying the current. The spot welding was performed in two types and three layers. The spot welding was performed by laminating in the order of evaluation material-evaluation material-GA 980DP 1.4 t (having a composition of 0.12 wt % of C, 0.1 wt % of Si, and 2.2 wt % of Mn). In the spot welding, a new electrode was welded to a soft material 15 times, the electrode was abraded, and then, an upper limit current at which expulsion occurred was measured with a spot welding target material. After measuring the upper limit current, spot welding was performed 8 times for each welding current at a current lower than the upper limit current by 0.5 and 1.0 kA, a cross-sectional surface of the spot welded zone was precisely processed by electric discharge processing and was epoxy-mounted and ground, and a length of a crack was measured with an optical microscope. The crack length was measured at points 0.5 cm apart, 1.0 cm apart, 15 cm apart and 30 cm apart from the edge of the plated steel sheet to the center side in the width direction of the plated steel sheet, and at the center of the plated steel sheet in the width direction. In the observation with the optical microscope, the magnification was set to be 100 times, and when no crack was observed at the magnification, it was determined that liquid metal embrittlement did not occur, and when a crack was observed, a length thereof was measured using image analysis software. Among the cracks measured at each point, the maximum crack length was evaluated, and it was determined as "good" when a length of a B-type crack generated at a shoulder portion of the spot welded zone was 100 μm or less, and was determined as "good" when no C-type crack was observed. The B-type crack length and C-type crack length shown in Table 3 refer to the maximum crack length among observed cracks.

In order to measure the depth of the internal oxide layer, a cross-section of the steel sheet was examined using a scanning electron microscopy (SEM). Specifically, SEM observation was performed on the cross-section of the steel sheet at points 0.5 cm apart, 1.0 cm apart, 15 cm apart and 30 cm apart from the edge of the plated steel sheet in the width direction to the center side in the width direction of the plated steel sheet, and at the center of the plated steel sheet in the width direction, and the depth of internal oxidation was measured using image analysis software.

Tensile strength was measured through a tensile test by making a C-direction sample of the JIS-5 standard. The coating weight was measured using a wet dissolution method using a hydrochloric acid solution. Sealer adhesion was checked by attaching an adhesive D-type for automotive structures to the plating surface and then bending the steel sheet at 90 degrees to check if the plating was removed. For powdering, after bending a plating material at 90 degrees, a tape was adhered to a bent region and then removed to check how many mm dropouts of the plated layer were dropped on the tape. When the length of the plated layer peeled off from the tape exceeded 10 mm, it was checked as defective. For flaking, it was processed in a 'U' shape, it was checked whether the plated layer was removed from a processing portion. GI and ZM steel sheets were subjected to a sealer bending test (SBT) to check whether the plated layer was peeled off and attached to a surface in which the sealer was removed when the steel sheet was bent at 90 degrees by attaching an adhesive for automobile structures to the surface. Surface quality was checked by visually checking whether there were any defects, such as unplating of the steel sheet, and if defects, such as unplating, were observed with the naked eyes, the steel sheet was determined to be defective.

TABLE 3

| Steel type | Specimen No. | Internal oxidation width direction average (a, μm) | Internal oxidation depth difference (b − c, μm) | Tensile strength (MPa) | Plating type | Coating weight (wt %) | Surface quality | PowDering (mm) | Flaking | SBT | LME occurrence B-type length (μm) | LME occurrence C-type length (μm) |
|---|---|---|---|---|---|---|---|---|---|---|---|---|
| F | 1 | 5.4 | 1.2 | 723 | GA | 49 | Poor | 11 | Good | — | 32 | ND |
| A | 2 | 1.2 | −0.2 | 1,246 | GI | 57 | Poor | — | — | Peeling | 105 | 354 |
| F | 3 | 4.6 | 0.1 | 954 | ZM | 53 | Good | 2 | — | Good | ND | ND |
| B | 4 | 0.4 | −0.5 | 1,186 | GA | 43 | Good | 1 | Good | — | 157 | 257 |
| D | 5 | 0.4 | −0.3 | 795 | ZM | 58 | Poor | — | — | Good | 182 | 624 |
| F | 6 | 2.5 | 1.3 | 995 | ZM | 49 | Good | — | — | Good | 65 | ND |
| E | 7 | 0.2 | −0.12 | 738 | GA | 44 | Good | 0 | Good | — | 41 | 621 |
| D | 8 | 5.1 | 0.02 | 952 | GI | 47 | Poor | — | — | Peeling | 21 | ND |
| B | 9 | 0.3 | −0.32 | 1208 | GI | 52 | Poor | — | — | Peeling | ND | ND |
| B | 10 | 3.5 | 0.5 | 1,032 | GI | 42 | Good | 5 | Good | — | 14 | ND |
| E | 11 | 4.2 | 0.2 | 1,025 | GA | 59 | Good | 4 | Good | — | 23 | ND |
| A | 12 | 1.35 | −0.12 | 1,235 | GI | 51 | Poor | — | — | Peeling | 154 | 351 |
| F | 13 | 2.1 | 0.1 | 989 | GA | 49 | Poor | 16 | Good | — | 24 | ND |
| D | 14 | 5.2 | 0.2 | 715 | GA | 42 | Poor | 15 | Good | — | ND | ND |
| D | 15 | 5.2 | 0.1 | 1,192 | GA | 47 | Good | 0 | Good | — | 45 | ND |
| F | 16 | 0.4 | −0.21 | 994 | GI | 42 | Poor | — | — | Peeling | 32 | 54 |
| B | 17 | 4.4 | 1.2 | 732 | GA | 47 | Poor | 16 | Good | — | 24 | ND |
| E | 18 | 2.6 | 1.2 | 1,125 | GA | 41 | Good | 0 | Good | — | ND | ND |
| C | 19 | 1.7 | −0.1 | 998 | ZM | 58 | Poor | — | — | Peeling | 184 | 657 |
| B | 20 | 4.2 | 0.01 | 712 | GA | 48 | Good | 2 | Good | — | 21 | ND |
| D | 21 | 0.4 | −0.2 | 741 | GA | 45 | Good | 1 | Good | — | 17 | 347 |
| E | 23 | 1.7 | −1.5 | 987 | GA | 46 | Good | 2 | Good | — | 154 | 325 |
| E | 24 | 4.5 | 0.4 | 1,153 | GA | 46 | Good | 1 | Good | — | 14 | ND |
| E | 25 | 1.4 | −1.9 | 1,026 | GA | 48 | Good | 2 | Good | — | 152 | 521 |
| B | 27 | 1.2 | −0.25 | 1,195 | GA | 54 | Good | 4 | Peeling | — | 105 | 248 |
| B | 28 | 2.2 | 0.9 | 1,247 | GA | 51 | Good | 4 | Good | — | 45 | ND |
| F | 29 | 1.2 | −0.133 | 1,198 | GA | 47 | Good | 1 | Peeling | — | 105 | 178 |

It can be seen that the specimens satisfying all the conditions of the present disclosure have good plating quality and spot welding LME crack length. Meanwhile, it can be seen that the specimens that do not satisfy any one of the conditions of the present disclosure have inferiority in any one or more of tensile strength, plating quality, and spot welding LME crack.

Although the present disclosure has been described in detail through examples above, other types of exemplary embodiments may also be implemented. Therefore, the spirit and scope of the claims set forth below are not limited to the exemplary embodiments.

The invention claimed is:

1. A zinc-plated steel sheet including a base steel sheet and a zinc-based plated layer provided on a surface of the base steel sheet, wherein an average depth (a) of an internal oxide layer formed in the base steel sheet is 2 μm or more, and a difference (b−c) between an average internal oxide layer depth (b) at an edge portion side of the plated steel sheet in the width direction and an average internal oxide layer depth (c) at a center portion of the plated steel sheet in the width direction exceeds 0, wherein the average internal oxide layer depth (b) at the edge portion side is an average value of internal oxide layer depths measured at a point spaced apart, by 0.5 cm, from the edge of the plated steel sheet in the width direction to the center portion side of the plated steel sheet in the width direction of the plated steel sheet and at a point spaced apart by 1.0 cm from the edge of the plated steel sheet in the width direction to the center portion side of the plated steel sheet in the width direction of the plated steel sheet, wherein the average internal oxide layer depth (c) at the center portion is an average value of internal oxide layer depths measured at a point spaced apart by 15 cm from the edge of the plated steel sheet in the width direction to the center portion side of the plated steel sheet in the width direction of the plated steel sheet, at a point spaced apart by 30 cm from the edge of the plated steel sheet in the width direction to the center portion side of the plated steel sheet in the width direction of the plated steel sheet, and at the center of the plated steel sheet in the width direction, and wherein the average depth (a) of the internal oxide layer formed in the base steel sheet is an average value of the average internal oxide layer depth (b) at the edge portion side and the average internal oxide layer depth (c) at the center portion.

2. The zinc-plated steel sheet of claim 1, wherein a coating weight of the zinc-based plated layer is 30 to 70 $g/m^2$.

3. The zinc-plated steel sheet of claim 1, wherein the base steel sheet includes, by wt %, C: 0.05 to 1.5%, Si: 2.5% or less, Mn: 1.5 to 20.0%, S—Al, acid-soluble aluminum: 3.0% or less, Cr: 2.5% or less, Mo: 1.0% or less, B: 0.005% or less, Nb: 0.2% or less, Ti: 0.2% or less, Sb+Sn+Bi: 0.1% or less, N: 0.01% or less, the balance of Fe, and inevitable impurities.

4. The zinc-plated steel sheet of claim 3, wherein tensile strength of the zinc-plated steel sheet is 900 MPa or more.

5. The zinc-plated steel sheet of claim 1, wherein a thickness of the base steel sheet is 1.0 to 2.0 mm.

6. A method of manufacturing a zinc-plated steel sheet, the method comprising:

reheating a steel slab to a temperature range of 950 to 1300° C.;

hot rolling the reheated slab at a finishing rolling start temperature of 900 to 1150° C. and a finishing rolling end temperature of 850 to 1050° C. to provide a hot-rolled steel sheet;

coiling the hot-rolled steel sheet in a temperature range of 590 to 750° C.;

heating both edges of the coiled hot-rolled coil to a temperature range of 600 to 800° C. at a heating rate of 10° C./s or more for 5 to 24 hours;

annealing the hot-rolled steel sheet at a dew point temperature of −10 to +30° C., an atmospheric gas of $N_2$-5 to 10% $H_2$, and a soaking zone in a temperature range of 650 to 900° C.;

slowly cooling the annealed hot-rolled steel sheet in a slow cooling zone in a temperature range of 550 to 700° C.;

quenching the slowly cooled hot-rolled steel sheet in a rapid cooling zone in a temperature range of 270 to 550° C.;

reheating the quenched hot-rolled steel sheet and then dipping the reheated steel sheet in a zinc-based plating bath at an inlet temperature of 420 to 550° C. to form a zinc-based plated layer; and selectively alloying the steel sheet on which the zinc-based plated layer is formed by heating in a temperature range of 480 to 560° C.

7. The method of claim 6, wherein a threading speed during the annealing is 40 to 130 mpm.

8. The method of claim 6, wherein the steel slab includes, by wt %, C: 0.05-0.30%, Si: 2.5% or less, Mn: 1.5-10.0%, S—Al (acid-soluble aluminum): 1.0% or less, Cr: 2.0% or less, Mo: 0.2% or less, B: 0.005% or less, Nb: 0.1% or less, Ti: 0.1% or less, Sb+Sn+Bi: 0.05% or less, N: 0.01% or less, the balance of Fe, and inevitable impurities.

9. The zinc-plated steel sheet of claim 2, wherein the base steel sheet includes, by wt %, C: 0.05 to 1.5%, Si: 2.5% or less, Mn: 1.5 to 20.0%, S-Al, acid-soluble aluminum: 3.0% or less, Cr: 2.5% or less, Mo: 1.0% or less, B: 0.005% or less, Nb: 0.2% or less, Ti: 0.2% or less, Sb+Sn+Bi: 0.1% or less, N: 0.01% or less, the balance of Fe, and inevitable impurities.

10. The zinc-plated steel sheet of claim 2, wherein a thickness of the base steel sheet is 1.0 to 2.0 mm.

* * * * *